US005726076A

United States Patent [19]

Tasker et al.

[11] Patent Number: 5,726,076

[45] Date of Patent: Mar. 10, 1998

[54] METHOD OF MAKING THIN-FILM CONTINUOUS DYNODES FOR ELECTRON MULTIPLICATION

[75] Inventors: G. William Tasker, West Brookfield, Mass.; Jerry Randall Horton, Cape Elizabeth, Me.

[73] Assignee: Center for Advanced Fiberoptic Applications, Southbridge, Mass.

[21] Appl. No.: 365,242

[22] Filed: Dec. 28, 1994

Related U.S. Application Data

[62] Division of Ser. No. 89,771, Jul. 12, 1993, Pat. No. 5,378,960, which is a continuation of Ser. No. 395,388, Aug. 18, 1898, abandoned.

[51] Int. Cl.[6] ..... H01J 41/00

[52] U.S. Cl. ..... 438/20; 427/77; 427/78

[58] Field of Search ..... 437/2, 3, 4, 5, 437/228, 225, 238, 239, 241, 242; 427/77, 78

[56] References Cited

U.S. PATENT DOCUMENTS

| | | | |
|---|---|---|---|
| Re. 31,847 | 3/1985 | Luckey | 250/327.2 |
| 3,675,063 | 7/1972 | Spindt et al. | 313/104 |
| 3,911,167 | 10/1975 | Linder | 117/201 |
| 3,959,038 | 5/1976 | Gutierrez et al. | 148/171 |
| 4,015,159 | 3/1977 | Zipfel, Jr. | 313/95 |
| 4,051,403 | 9/1977 | Feingold et al. | 313/105 |
| 4,073,989 | 2/1978 | Wainer | 428/131 |
| 4,093,562 | 6/1978 | Kishimoto | 252/511 |
| 4,095,132 | 6/1978 | Fraioli | 313/103 CM |
| 4,236,073 | 11/1980 | Martin | 250/306 |
| 4,352,985 | 10/1982 | Martin | 250/306 |
| 4,454,422 | 6/1984 | Persyk | 250/363 |
| 4,468,420 | 8/1984 | Kawahara et al. | 427/397.7 |
| 4,558,144 | 12/1985 | Fay et al. | 556/40 |
| 4,563,250 | 1/1986 | Becker et al. | 204/6 |
| 4,577,133 | 3/1986 | Wilson | 313/103 CM |
| 4,757,229 | 7/1988 | Schmidt et al. | 313/103 CM |
| 4,780,395 | 10/1988 | Saito et al. | 430/315 |
| 4,800,263 | 1/1989 | Dillon et al. | 250/213 R |
| 4,825,118 | 4/1989 | Kyushima | 313/104 |

FOREIGN PATENT DOCUMENTS 2180986 4/1987 United Kingdom .

OTHER PUBLICATIONS

Silicon Processing for the VLSI Era, vol. 1, Wolf and Tauber, Lattice Press, 1986, pp. 161–165, 331–333 and 374–377.

Lampton, Michael "The Microchannel Image Intensifier", Sci Am., Nov. 1981, vol. 245, No. 5, pp. 62–71.

Washington, D. "Technology of Channel Plate Manufacture", Acta Electronica, vol. 14, No. 2, 1971, pp. 201–224.

Trap, H.J.L. "Electronic Conductivity in Oxide Glasses", Acta Electronica, vol. 14, No. 1, 1971, pp. 41–77.

Hill, G. "Secondary Electron Emission and Compositional Studies on Channel Plate Glass Surfaces", Advances in Elect., vol. 40A, p. 153.

Tyutikov, A.M. "Study of the Surface Layer Composition and the Secondary Electron Emission Coeficient of Lead Silicate Glass", Sov. J. Opt. Technol. 47(4), Apr. 1980, pp. 201–207.

S. Meonova, Ju. "Surface Compositional Studies of Heat Reduced Lead Silicate Glass", Journal of Non–Crystalline Solids, 57, (1983) 177–187.

*Primary Examiner*—Charles L. Bowers, Jr.
*Assistant Examiner*—Matthew Whipple
*Attorney, Agent, or Firm*—Watson Cole Stevens Davis

[57] ABSTRACT

The invention is directed to continuous dynodes formed by thin-film processing techniques. According to one embodiment of the invention, a continuous dynode is formed by reacting a chemical vapor in the presence of a substrate at a temperature and pressure sufficient to result in chemical vapor deposition. In another embodiment, the layer is formed by liquid phase deposition and in another embodiment, the layer is formed by nitriding or oxidizing a substrate.

49 Claims, 7 Drawing Sheets

METHOD OF MAKING THIN-FILM CONTINUOUS DYNODES FOR ELECTRON MULTIPLICATION

This is a Division of application Ser. No. 08/089,771 filed Jul. 12, 1993, now U.S. Pat. No. 5,378,960 which in turn is a Continuation of Ser. No. 395,558 filed Aug. 18, 1989, abandoned.

BACKGROUND OF THE INVENTION

Channel electron multipliers 10 (CEMs) (FIG. 1) and microchannel plates 20 (MCPs) (FIG. 2) are efficient, low-noise, vacuum-electron amplifiers with typical gains (G)= $I_o/I_i$ in the range of $10^3$–$10^8$, where $I_o/I_i$ is the ratio of the output to input currents. CEMs 10 are devices which have a single channel 12 and are generally used for direct detection of charged particles (e.g., electrons and ions) and photons from soft X-ray to extreme ultraviolet wavelengths (i.e., 1–100 nm). They are mainly used as detectors in a wide variety of scientific instrumentation for mass spectrometry, electron spectroscopy for surface analysis, electron microscopy, and vacuum ultraviolet and X-ray spectroscopy.

MCPs 20 are fabricated as area arrays of millions of essentially independent channel electron multipliers 22 which operate simultaneously and in parallel. Using an MCP, direct detection of charged particles and sufficiently energetic electromagnetic radiation can be achieved in two dimensions over large areas (up to several hundred $cm^2$), with good resolution (channel spacing or pitch <10 μm), at fast response times (output pulse widths <300 ps), and with linear response over a broad range of input event levels ($10^{-12}$–$10^{-8}$A). By placing an MCP between a suitable photocathode and fluorescent screen in an optical image tube (not shown), two-dimensional signals from the ultraviolet to the near-infrared spectral region can be intensified and displayed as a visible image. While MCPs continue to find major application in image tubes for military night-vision systems, there is now growing interest in MCPs for high-performance commercial applications as well. These presently include high-speed and high-resolution cameras, high-brightness displays, and state-of-the-art detectors for scientific instrumentation.

CEMs and MCPs essentially consist of hollow, usually cylindrical channels. When operated at pressures $<1.3\times10^{-4}$ Pa ($10^{-6}$ torr) and biased by an external power supply, such channels support the generation of large electron avalanches in response to a suitable input signal. The cutaway view of FIG. 1 shows CEM 10 in operation. The process of electron multiplication in a straight channel does not critically depend on either the absolute diameter (D) or length (L) of the channel, but rather on the L/D ratio (α). For a curved channel, the ratio (β) of the channel length L to the radius of channel curvature (S), L/S, is the important parameter. These geometric ratios largely determine the number of multiplication events (n) that contribute to the electron avalanche. Typical values of α range from 30 to 80 for conventional CEMs and MCPs with channel diameters D on the scale of 1 mm and 10 μm, respectively. Thus, a CEM 10 is a single channel electron multiplier of macroscopic dimensions while MCP 20 is a wafer-thin array of microscopic electron multipliers with channel densities of $10^5$–$10^7/cm^2$.

The channel wall 14 of CEM 10 or the wall 24 of the MCP 20 acts as a continuous dynode for electron multiplication and may be contrasted with the operation of photoemissive detectors using discrete dynodes (e.g., an ordinary photomultiplier tube). In operation, the continuous dynodes 14 and 24 must be sufficiently resistive to support a biasing electric field (ε)=$10^2$–$10^5$ V/cm without drawing an excessive current. They must also be conductive enough such that a discharging current is available to replenish electrons emitted from the dynode 14,24 during an electron avalanche. For example, when a signal event 30 such as an electrically charged particle (FIG. 1) (e.g., an electron or a $Ne^+$ ion) or sufficiently energetic radiation (e.g., an X-ray photon) strikes the channel wall 14 near the negatively biased input end 32, there is a good probability that electrons 34 will be ejected from the surface 14. These primary electrons 34 are accelerated down the channel 12 by an applied electric field ε (see arrow 36) produced by the bias potential ($V_B$) represented by the power supply 38. $\epsilon=V_B/L$, where $V_B$ in volts~20–25α for a conventional straight-channel multiplier. Collision of the emitted electrons 34 with the channel wall 14 causes the emission of secondary electrons 40. These secondary electrons in turn act as primary electrons in subsequent collisions with the channel wall 14 which produce another generation of secondary electrons. Provided that more than one secondary electron is emitted for every incident primary electron, the secondary electron yield (δ)>1, and n repetitions of this primary collision-secondary emission sequence in the direction of the output end 41 rapidly leads to an output electron avalanche 42 of magnitude $\delta^n$.

The near-surface region of the dynode 14 must have an average value of δ sufficiently greater than unity to support efficient multiplication of primary electrons impinging on a channel wall with energies ($E_p$) mostly in the range of 20–100 eV. For materials with good secondary electron emission properties, δ initially increases with $E_p$ from δ<1 to δ=1 at the first crossover energy $E_p^I$, and then to δ>1. Emissive materials of greatest interest for electron multipliers tend to have values of $E_p^I$ in the range of about 10 eV≦$E_p^I$≦50 eV, the smaller the better. For such materials, a linear approximation of δ($E_p$) is $\delta=E_p/E_p^I$ for $E_p$≦100 eV. As an example, if $E_p^I$=30 eV for the continuous dynodes in conventional CEMs and MCPs, then an estimate of the range of δ for primary electrons with $E_p$=20–100 eV is 0.7≦δ≦3.3. Now, for a straight-channel multiplier with α=40, $V_B$=1000 V, $E_p^I$=30 eV, and a most probable initial energy ($E_s$)=3 eV for a secondary electron as it emerges from the dynode surface, the electron gain G from a single input electron is approximately calculated as follows:

$$G=\delta^n = \left[\frac{\overline{E}_p}{E_p^I}\right]^n = \left[\frac{(qV_B)^2}{(4\,\overline{E}_s E_p^I \alpha^2)}\right]^{\left(\frac{4\overline{E}_s\alpha^2}{qV_B}\right)} = 4\times10^4.$$

The most probable collision energy of the primary electrons $$(\overline{E_p})=(qV_B)^2/4\overline{E}_s\alpha^2\simeq52\text{ eV};$$

the average yield or gain per multiplication event $$\delta=(qV_B)^2/4\overline{E}_s\overline{E}_p^I\alpha^2\simeq1.75;$$

the number of the multiplication events $$n=4\overline{E}_s\alpha^2/qV_B\simeq19;$$

and, q is the magnitude of electronic charge.

When the electron avalanche emerges from the channel as an output signal, it typically represents a very large amplification of the original input signal. Because electron multiplication increases geometrically down the length of a channel, signal gains G ranging from $10^3$ to $10^8$ can be obtained depending upon the specific dynode materials, channel geometry, detector configuration, and application.

Straight-channel multipliers are limited to electron gains of about $10^4$ due to a phenomenon known as positive ion feedback. Near the output end of a channel multiplier and above some threshold gain, residual gas molecules within the channel or gasses adsorbed on the channel wall can become ionized by interaction with the electron avalanche. In contrast to the direction of travel for electrons with negative electrical charge, positive ions are accelerated toward the negatively-biased input end of the channel. Upon striking the channel wall, these ions cause the emission of electrons which are then multiplied geometrically by the process described above. Spurious and at times regenerative output pulses associated with ion feedback can thus severely degrade the signal-to-noise characteristics of the detector.

An effective method for reducing ion feedback in channel multipliers is to curve the channel. Channel curvature restricts the distance that a positive ion can migrate toward the input end of a channel, and hence greatly reduces the amplitude of spurious output pulses. Single MCPs with straight channels typically provide electron gains of $10^3$–$10^4$. Curved-channel MCPs can produce gains of $10^5$–$10^6$ but are difficult and expensive to manufacture. Curved-channel CEMs can operate at gains in excess of $10^8$.

MCPs 20 are usually fabricated with channels 22 that are inclined at an angle of ~10° relative to a normal projection from the flat parallel surfaces 26 of the device. This is done to improve the first strike efficiency of an input event. Stacking MCPs and alternating the rotational phase of the channel orientation by 180° provides another means for overcoming ion feedback in MCP detectors. Two-stage (Chevron™) and three-stage (Z-stack) assemblies of MCPs thereby produce gains of $10^6$–$10^7$ and $10^7$–$10^8$, respectively.

The channel wall of a CEM or MCP acts as a continuous dynode for electron multiplication and may be contrasted elsewhere with the operation of detectors using discrete dynodes (e.g., an ordinary photomultiplier tube). A continuous dynode must be sufficiently conductive to replenish electrons which are emitted from its surface during an electron avalanche. In analog operation of CEMs and MCPs at a given gain G, the output current $I_o$ from a channel is linearly related to the input current $I_i$ providing the output does not exceed about 10% of the bias current ($i_B$), imposed by $V_B$, in the channel wall. Above a threshold input level, $I_i \sim 0.1 i_B/G$, gain saturation occurs and current transfer characteristics are no longer linear. On the other hand, the continuous dynode must also be resistive enough to support a biasing field $\epsilon = 10^2$–$10^5$ V/cm without drawing an excessive $i_B$, as manifest by thermal instability that is associated with Joule heating. Moreover, the near-surface region of the dynode must have an average value of $\delta$ sufficiently greater than unity to support efficient multiplication of electrons impinging on a channel wall, as discussed above.

The electrical and electron emissive properties of continuous dynodes in the current generation of CEMs and MCPs critically depend on details of their manufacture. MCPs are presently fabricated by a glass multifiber draw (GMD) process that includes drawing a rod-in-tube glass fiber of a barium borosilicate core glass clad with a lead silicate glass; stacking the composite fiber into a hexagonal array and redrawing glass multifiber bundles; stacking of multifiber bundles and consolidating into a billet consisting of an array of solid core glass channels imbedded in a cladding glass matrix; wafering of the billet and surface finishing; wet chemical processing to remove the core glass leaving behind an array of hollow channels extending through a wafer of cladding glass; additional wet chemical processing to enhance secondary emission from the channel surface; reducing the lead silicate glass in a hydrogen atmosphere to render the dynode surface electronically conductive with a sheet resistance ($R_s$)=$10^{11}$–$10^{14}\Omega$/sq; and electroding of the flat surfaces of the MCP wafer.

Fabrication of CEMs is simpler; it entails thermal working of lead silicate glass tubing into a suitable geometry; reducing the glass in hydrogen to produce a continuous dynode surface with $R_s = 10^6$–$10^8\Omega$/sq, and electroding. On account of the vastly different values of $R_s$ that are required for continuous dynodes in MCPs versus CEMs, compositionally distinct lead silicate glasses have been formulated for each application.

The hydrogen reduction step is essential to the operation of conventional electron multipliers. Lead cations in the near-surface region of the continuous glass dynode are chemically reduced in a hydrogen atmosphere at temperatures of about 350°–500° C. from the $Pb^{2+}$ state to lower oxidation states with the evolution of $H_2O$ as a reaction product. The development of significant electronic conductivity in a region no more than about 1 μm beneath the surface of reduced lead silicate glass (RLSG) dynodes has been explained in two rather different ways. One theory holds that a small fraction (i.e., ~$10^{-6}$) of the lead atoms within the reaction zone remains atomically dispersed in multiple valence states (i.e., $Pb^{1+}$ and $Pb^0$). An electron hopping mechanism via localized electronic states in the band gap, associated with lead atoms in the multiple valence states, is said to give rise to electronic conduction. Another theory, noting that most of the lead atoms within the reaction zone are reduced to the metallic state and are agglomerated into droplet-like particles with a discontinuous morphology, suggests that electronic conduction derives from a tunneling mechanism between such particles. Regardless of the mechanism that ultimately proves correct, one can expect that the electrical characteristics of RLSG dynodes are a complex function of the chemical and thermal history of the glass surface as determined by the details of its manufacture.

During hydrogen reduction, other high-temperature processes including diffusion and evaporation of mobile chemical species in the lead silicate glass (e.g., alkali, alkaline earth, and lead atoms) also act to modify the chemistry and structure of RLSG dynodes. Compositional profiles through the near-surface region of glasses that are used in the manufacture of MCPs have indicated that RLSG dynodes have a two-layer structure.

An exemplary RLSG dynode 50, shown in FIG. 3, comprises a superficial silica-rich and alkali-rich, but lead-poor dielectric emissive layer 52 about 2–20 nm in thickness (d) that produces adequate secondary emission (i.e., $E_p^I \sim 30$ eV) to achieve useful electron multiplication. Beneath this dielectric emissive layer 52 (or dynode surface), a semiconductive lead-rich layer 54 about 100–1000 nm in thickness (t) serves as an electronically conductive path for discharging the emissive layer 52. Upon consideration of the ranges of $R_s$ for RLSG dynodes given above and assuming the semiconductive layer 54 has a thickness t=100 nm, it can be readily shown that the bulk electrical resistivity (r) of the material comprising semiconductive layer 54 is $r = R_s \cdot t = 10^1$–$10^3\Omega$.cm for CEM dynodes and $r = 10^6$–$10^9\Omega$.cm for MCP dynodes. A base glass 56 provides mechanical support for the continuous RLSG dynode 50 in the geometry of macroscopic channels for CEMs or arrays of microscopic channels for MCPs. The interface 58 shown schematically in FIG. 3 between the conductive 54 and emissive 52 layers in actual RLSG dynodes is rather less distinct than illustrated in FIG. 3; this schematic structure, however, does provide a useful model.

While the manufacturing technology of RLSG MCPs and CEMs is mature, relatively inexpensive, and reasonably efficient, it imposes important limitations on current device technology and its future development. These limitations are summarized as follows. Both electrical and electron emissive properties of RLSG dynodes are quite sensitive to the chemical and thermal history of the glass surface comprising the dynode. Therefore, reproducible performance characteristics for RLSG MCPs and CEMs critically depend upon stringent control over complex, time-consuming, and labor-intensive manufacturing operations. In addition, the ability to enhance or tailor the characteristics of RLSG MCPs and CEMs is constrained by the limited choices of materials which are compatible with the present manufacturing technology. Gain stability, maximum operating temperature, background noise, and heat dissipation in high-current devices are several key areas where performance is adversely affected by material limitations of the lead silicate glasses that are used in the manufacture of conventional MCPs and CEMs.

The GMD process also imposes important manufacturing constraints on the geometry, and hence on the performance and applications of RLSG MCPs in the following ways: channel diameters ≧4 μm and channel pitches ≧6 μm in current practice limit temporal and spatial resolution; quasi-periodic arrays of channels within multifiber regions and gross discontinuities at adjacent multifiber boundaries greatly complicate the task of addressing or reading out individual or small blocks of channels; variations in channel diameter from area to area in an array are manifest as patterns with differential gain; and the largest size of a microchannel array is now limited to a linear dimension on the order of 10 cm. A patent of Horton et al. U.S. Pat. No. 5,205,902 addresses these problems.

Finally, despite the major market for MCPs in military night vision devices, other substantial applications for these remarkable detectors have been slow to evolve in part because they are difficult to interface with solid-state electronics. Greater compatibility with semiconductor electronics (e.g., with regard to materials of construction, interconnection, or power requirements for operation) would facilitate the implementation of important new applications including commercial night vision, optical computing, and high-performance display, photographic, and imaging technologies.

SUMMARY OF THE INVENTION

The invention is directed to continuous dynodes formed by thin film processing techniques. According to one embodiment of the invention, a continuous dynode is disclosed in which at least one layer is formed by reacting a vapor in the presence of a substrate at a temperature and pressure sufficient to result in chemical vapor deposition kinetics dominated by interfacial processes between the vapor and the substrate. In another embodiment the surface of a substrate or surface of a thin film previously deposited on a substrate is subjected to a reactive atmosphere at a temperature and pressure sufficient to result in a reaction modifying the surface. In yet another embodiment a continuous dynode is formed in part by liquid phase deposition of a dynode material onto the substrate from a supersaturated solution. The resulting devices exhibit conductive and emissive properties suitable for electron multiplication in CEM, MCP and MEM applications. In the preferred embodiment, the thin-films are conformed with the substrate surface and the emissive layer is hermetic.

DESCRIPTION OF THE PREFERRED EMBODIMENT

According to one embodiment of the present invention current carrying (e.g. semiconductive) and dielectric thin films may be vapor deposited along the walls of capillary channels within suitable substrates to yield continuous dynodes which replicate the function of reduced lead silicate glass (RLSG) dynodes. Such devices may be comprised of thin film dynodes that are supported by dielectric or semiconductive substrates in the configuration of CEMs and MCPs. For electrically insulating substrates, deposition of both a current carrying or semiconductive layer and an electron emissive layer would generally be necessary; however, appropriately semiconductive substrates would only require the deposition of an emissive layer.

Figure 4:
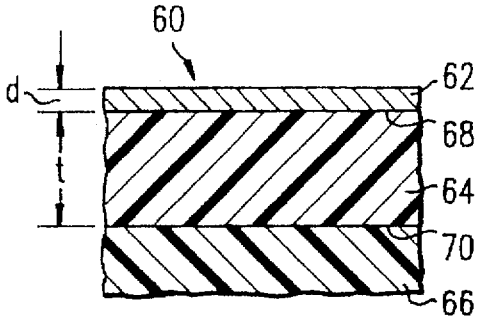
FIG. 4 is a side sectional schematic illustration of a thin film continuous dynode according to one embodiment of the present invention employing a dielectric substrate.

An example of a continuous thin-film dynode 60, according to one embodiment of the present invention, is illustrated in FIG. 4. The dynode 60 comprises an emissive layer or film 62, a semiconductive layer or film 64 and a dielectric substrate 66. The dynode 60 is formed by depositing the semiconductive film such as silicon to a thickness t in the range of 10–1000 nm onto the surface 70 of the substrate 66 such as silica glass. By controlling the concentration of a suitable dopant (e.g., phosphorous) and the morphology of the film, a silicon semiconductive layer 64 with, for instance, $t \simeq 100$ nm can thus be obtained with resistivity $r=10^1-10^3\Omega$.cm yielding $R_s=r/t \simeq 10^6-10^8\Omega/sq$ for CEM dynodes, or $r=10^6-10^7\Omega$.cm giving $R_s \simeq 10^{11}-10^{12}\Omega/sq$ for MCP dynodes. Other silicon semiconductive films with higher resistivities in the range of $r=10^7-10^9\Omega$.cm, yielding $R_s=10^{12}-10^{14}\Omega/sq$ for MCP dynodes, may be prepared by incorporation of other dopants to form semi-insulating films (e.g., SIPOS).

In a preferred embodiment deposition is achieved by a chemical vapor deposition (CVD) technique. As used and understood herein, the term CVD refers to the formation of thin films under conditions which are generally controlled by interfacial processes between gaseous reactants or reaction products and the substrate rather than by the transport of chemical species through the gas phase near the surface of the substrate.

In the embodiment illustrated in FIG. 4, the emissive layer 62 may comprise a thin layer of $SiO_2$, a native oxide about 2–5 nm in thickness d, overlying the silicon semiconductive layer 64, and be formed by exposure of the semiconductor surface 68 to ambient. Alternatively, the emissive layer 62 of thermal $SiO_2$or $Si_3N_4$ may be formed or grown to a thickness of 2–20 nm by oxidation or nitriding of the semiconductor surface 68 at elevated temperatures in the presence of reactive gases (e.g., $O_2$ or $NH_3$). As another alternative, an emissive film 62 such as MgO with higher secondary electron yield than thermal $SiO_2$ for electron energies $E_p$ of interest may be deposited by a CVD process to a thickness d=2–20 nm upon the surface 68 of semiconductive layer 64 to form the basic two-layer structure of the thin film dynode 60. For thermal $SiO_2$, if $E_p^I \sim 40$ eV and $\delta \sim E_p/E_p^I$, then $0.5 \leqq \delta \leqq 2.5$ for 20 eV$\leqq E_p \leqq$100 eV; whereas for MgO, if $E_p^I \sim 25$ eV, then $0.8 \leqq \delta \leqq 4$ for the same range of $E_p$. As an alternative to dielectric emissive layers, semiconductive films with surfaces exhibiting negative electron affinity, and thus highly efficient secondary electron emission, may also be formed by CVD methods (e.g., GaP:Cs—O, GaP:Ba—O, GaAs: Cs—O, InP:Cs—O and Si:Cs—O).

Generally, the thickness t and resistivity r of the semiconductive layer 64 (and therefore sheet resistance $R_s=r/t$) should be uniform along the length of a thin-film dynode 60 to provide a constant electric field in which to accelerate multiplying electrons. Also, the secondary electron yield $\delta$ of the emissive layer 62 should be sufficiently high and spatially uniform to produce adequate signal gain with good multiplication statistics. However, if desired, the layers 62,64 may be formed in radially graded or longitudinally staged CVD applications in order to produce a continuous thin film dynode having graded properties throughout its thickness or incrementally staged properties along its length, respectively. Also, although not always noted in detail, modification of the surface of a bulk semiconductor substrate or a deposited thin film to achieve suitable electron emissive properties may be effected by subsequent oxidation or nitriding.

Substrates for CEMs and MCPs can be either electrically insulating or semiconductive. Insulating substrates 66 (i.e., $r \geqq 10^{12}\Omega$.cm) would generally require deposition of both the electronically semiconductive layer 64 and the electron emissive layer 62 to form the efficient thin-film dynode 60 (FIG. 4).

Figure 5:
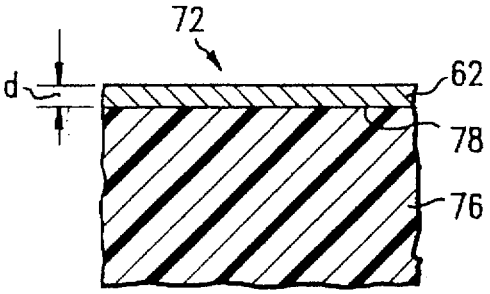
FIG. 5 is a side sectional schematic illustration of a thin film dynode according to another embodiment of the present invention employing a semiconductive substrate.

In contrast, and in accordance with another embodiment of the present invention shown in FIG. 5, the continuous dynode 72 comprises an emissive layer 62 such as MgO deposited on the surface 78 of a suitably semiconductive substrate 76, where $r=10^5-10^7\Omega$.cm for a CEM and $r=10^8-10^{11}\Omega$.cm for an MCP. The bias current for the dynode 72 could be carried throughout the bulk of the substrate 76. Also, as shown in the embodiment illustrated in FIG. 6, a dynode 80 having a somewhat more conductive substrate 82 could be employed by first depositing a dielectric isolation layer 84 (e.g., a film of $SiO_2$ formed by liquid phase deposition from a supersaturated solution) having thickness (z)=2–5 μm on the substrate 82 prior to formation of the semiconductive 64 and electron emissive 62 layers.

Figure 6:
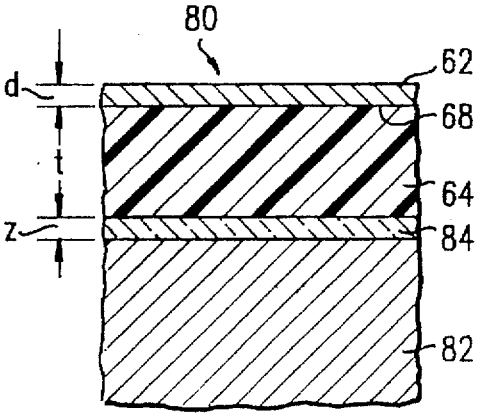
FIG. 6 is a side sectional schematic illustration of a thin film dynode according to another embodiment of the present invention employing a conductive substrate.

Use of insulating 66 or electrically-isolated 82 substrates as in FIGS. 4 and 6 for fabrication of thin-film electron multipliers by deposition of conductive and emissive layers is the preferred embodiment of this invention. Greater flexibility in the selection of electrical properties for a given device and likely better control of such properties during manufacture are major advantages of this approach. However, for certain applications (e.g., reduction of positive ion feedback), the bulk conductive device 72 of FIG. 5 might hold particular attraction.

Figure 1:
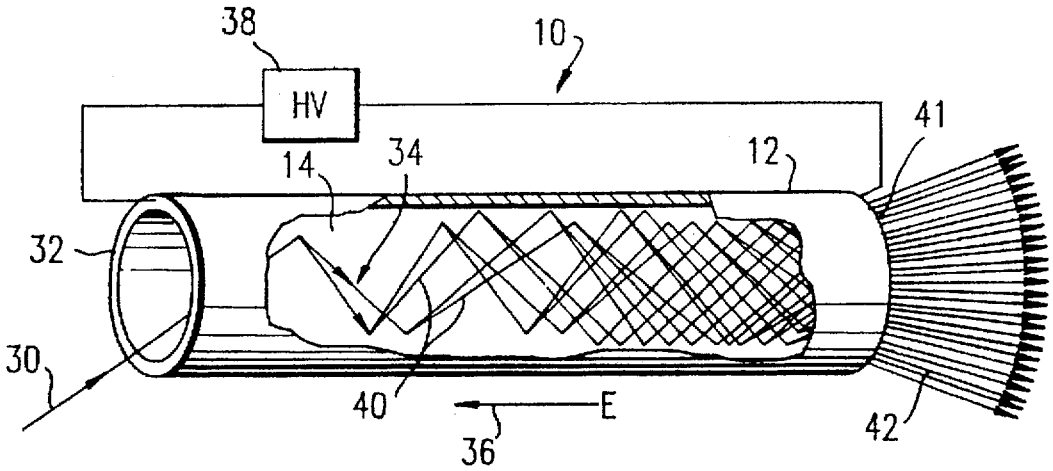
FIG. 1 PRIOR ART
FIG. 1 is a fragmentary schematic illustration in perspective of a channel electron multiplier (CEM) according to the prior art.
Figure 2:
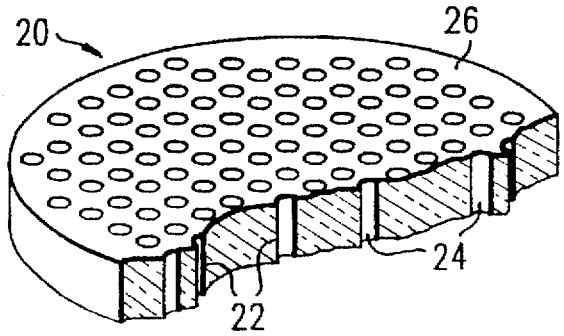
FIG. 2 PRIOR ART
FIG. 2 is a fragmentary schematic illustration in perspective of a microchannel plate (MCP) according to the prior art.
Figure 3:
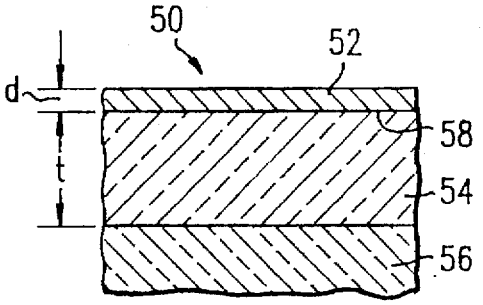
FIG. 3 PRIOR ART
FIG. 3 is a side sectional schematic illustration of a reduced lead silicate glass (RLSG) dynode according to the prior art.
Figure 7:
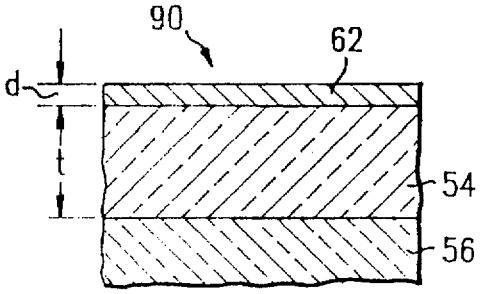
FIG. 7 is a side sectional schematic illustration of a thin film dynode according to another embodiment of the present invention employing a lead silicate glass substrate and RLSG semiconductive layer.

In current manufacturing practice, multicomponent lead silicate glass surfaces are chemically and thermally processed to produce continuous RLSG dynodes with appropriate electrical and secondary emission characteristics (FIG. 3). However, in another embodiment of the present invention, illustrated in FIG. 7 the RLSG dynode 90 is comprised of a dielectric emissive layer 62 and an underlying semiconductive layer 54. This two-layer structure is mechanically supported by the lead silicate base glass 56 in channel geometries which are characteristic of CEMs or MCPs. The emissive layer 62 in contrast to prior RLSG dynodes (FIG. 3) is preferably formed by CVD of an appropriate material such as $Si_3N_4$, MgO, or the like. The semiconductive layer 54 may be formed by $H_2$ reduction under conditions sufficient to promote formation of the semiconductive layer but minimize the formation of emissive layer 52, as in conventional RLSG dynodes (FIG. 3).

Further, when used as an emissive layer 62 in any of the embodiments of FIGS. 4–7, $Si_3N_4$ acts as a hermetic seal to protect the underlying surfaces from environmental degradation thereby enhancing the product shelf life. $Si_3N_4$, and $Al_2O_3$ are also more resistant than $SiO_2$ or $SiO_2$-rich glasses to degradation under electron bombardment thereby extending the operational lifetime of the dynode.

Figure 8:
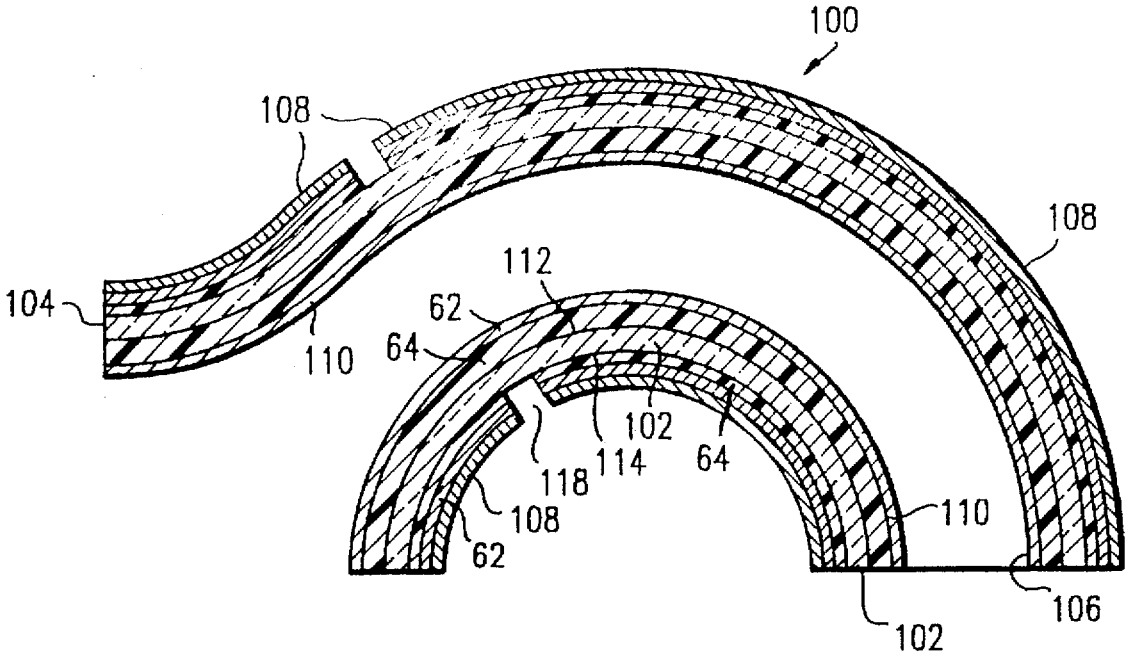
FIG. 8 is a fragmentary schematic side sectional illustration of a curved channel electron multiplier employing a thin film dynode according to the present invention.
Figure 9:
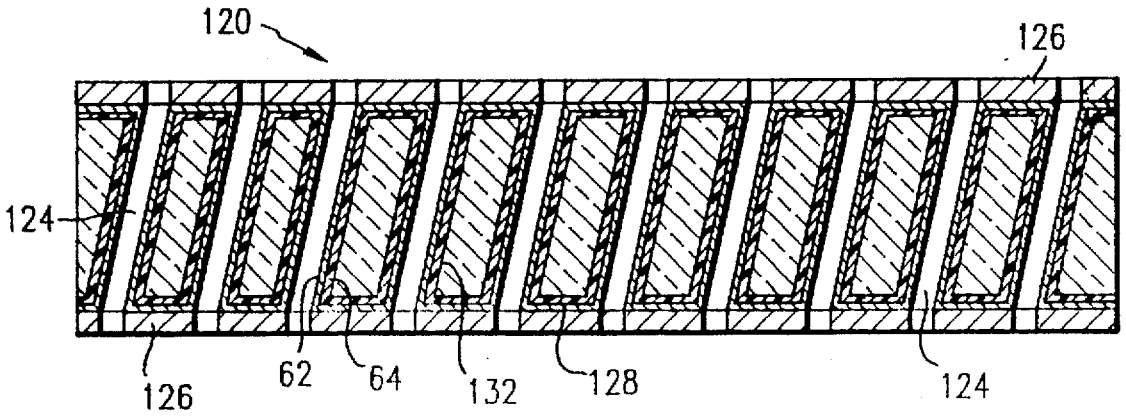
FIG. 9 is a fragmentary schematic side sectional illustration of a microchannel plate employing a thin film dynode according to the present invention.
Figure 10:
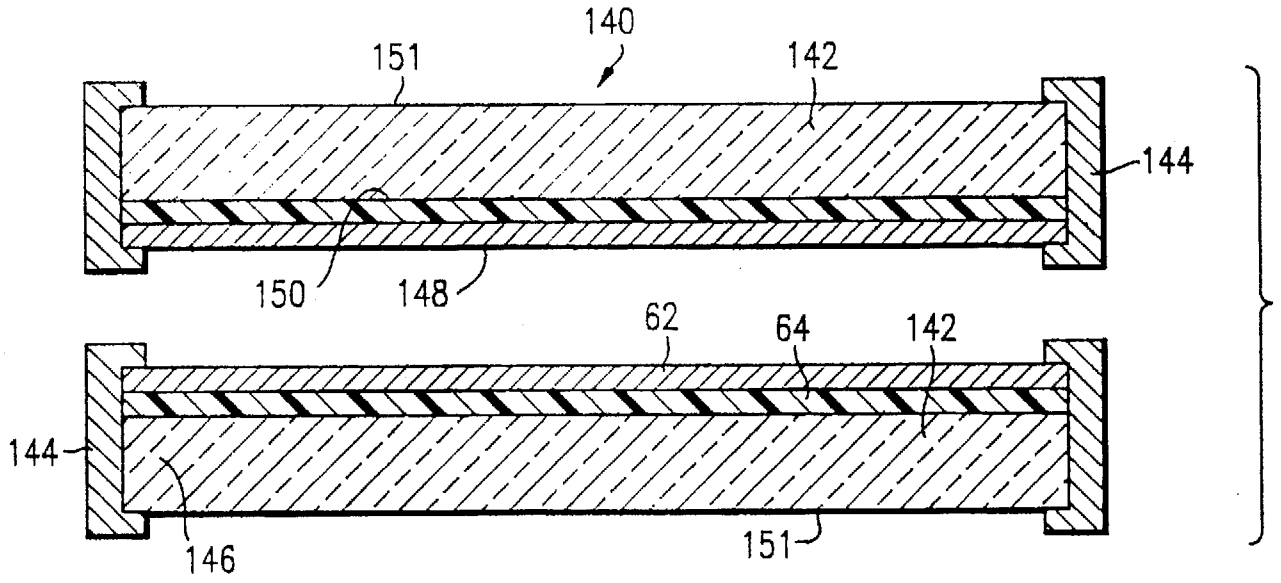
FIG. 10 is a schematic illustration in perspective of a magnetic electron multiplier (MEM) employing a thin-film dynode according to the present invention.

Exemplary devices employing thin film dynodes in accordance with the embodiment of FIG. 4 are illustrated in FIGS. 8–10. It should be understood, however, that any of the aforementioned alternative embodiments of thin film dynodes illustrated in FIGS. 5–7 may also be employed with the exemplary embodiments of FIGS. 8–10. In FIG. 8 a CEM 100 is illustrated which is formed of a curved capillary glass tube 102 having a flared input end 104 and a straight output end 106. If desired, the tube 102 may be formed of a molded and sintered dielectric block of ceramic or glass. Electrodes 108 are formed on the exterior of the tube 102 and thin-film dynode 110 is formed on the interior of the tube as shown.

In accordance with the invention the tube 102 is first subjected to a two-stage CVD process whereby the respective exterior and interior surfaces 114 and 112 are successively coated in a reactor (not shown) with a semiconductive layer 64 and emissive layer 62 which are shown in the enlargement. The exterior of the tube 102 is masked and stripped (e.g., by sandblasting or etching) to produce a nonconductive band 118 on the exterior wall 114. Metal electrodes 108 are thereafter applied by a suitable evaporation procedure. The semiconductive layer 64 and emissive layer 62 in the internal surface 112 functions as the continuous thin film dynode 110.

In FIG. 9 an MCP 120 is illustrated which comprises a dielectric ceramic or glass substrate 122 formed with microchannels 124 and electrodes 126 deposited on the opposite faces 128 of the substrate 122. Thin-film dynodes 130 formed of an emissive layer 62 and a semiconductive layer 64 as hereinbefore described are deposited on the walls 132 of the channels 124. (Portions of the films 62, 64 which coat the substrate 122 elsewhere do not function as a dynode.) The electrodes 126 are deposited atop the films (62,64) on the flat parallel faces 128 of the substrate 122. In accordance with the invention, the MCP 120 may be formed by the GMD process described above or by an anisotropic etching technique described in an application of Horton et al. commonly assigned to the assignee herein.

In FIG. 10 a magnetic electron multiplier (MEM) 140 is illustrated which is formed, in part, by a pair of glass plates 142 or other suitable dielectric substrate having electrodes 144 on the ends 146 and thin-film dynodes 148 on the confronting surfaces 150. The dynode 148 is formed of an emissive layer 62 and a semiconductive layer 64 as hereinbefore described. The electrodes 144 are deposited after stripping the exterior surfaces 151 to remove films (62,64).

The process of forming thin-film continuous dynodes according to the present invention in capillary channels of macroscopic to microscopic dimensions for CEMs and MCPs follows. Chemical vapor deposition (CVD) according to one embodiment of the present invention is a method by which thin solid films of suitable materials (e.g. semiconductors or ceramics) are vapor deposited onto the surface of a substrate by reaction of gaseous precursors. Temperature, pressure, and gaseous reactants are selected and balanced so that the physical structure and electrical and electron emissive properties of the dynodes so produced are appropriate for achieving the performance desired. In thermally-activated CVD processes, the substrate is typically heated to a temperature (T)=300°–1200° C., that is sufficient to promote the deposition reaction; however, such reactions can also be plasma-assisted or photochemically-activated at even lower temperatures. Basic deposition reactions include pyrolysis, hydrolysis, disproportionation, oxidation, reduction, synthesis reactions and combinations of the above. According to the invention, low pressure CVD (LPCVD) occurring preferably at pressures less than 10 torr and more desirably between about 1 and 0.1 torr, results in the formation of a satisfactory continuous thin-film dynode. Generally, LPCVD results in conformal thin-films usually having substantially uniform geometrical, electrical and electron emissive properties. The deposition reactions preferably occur heterogeneously at the substrate surface rather than homogeneously in the gas phase. Metal hydrides and halides as well as metalorganics are common vapor precursors.

Physical properties of CVD thin films are a function of both the composition and structure of the deposit. The range of materials that has been produced by CVD methods is quite broad and includes the following: common, noble, and refractory metals (e.g., Al, Au, and W); elemental and compound semiconductors (e.g., Si and GaAs); and ceramics and dielectrics (e.g., diamond, borides, nitrides, and oxides). Properties of such thin-film materials can be varied significantly by incorporation of suitable dopants, or by control of morphology. The morphology of CVD materials can be single crystalline, polycrystalline, or amorphous depending on the processing conditions and the physicochemical nature of the substrate surface. Also, materials of exceptional purity can be prepared by CVD techniques.

In general, the emissive portion of the dynodes of the present invention may be formed of $SiO_2$, $Al_2O_3$, MgO, $SnO_2$, BaO, $Cs_2O$, $Si_3N_4$, $Si_xO_yN_z$, C (Diamond), BN, and AlN; negative electron affinity emitters GaP:Cs—O, GaP:Ba—O, GaAs:Cs—O, InP:Cs—O, and Si:Cs—O. Such materials may be formed from precursors such as $SiH_4$, $SiCl_xH_y$, $Si(OC_2H_5)_4$, β-diketonate compounds of Al (e.g., $Al(C_5HO_2F_6)_3$), $Al(CH_3)_3$, β-diketonate compounds of Mg (e.g. , $Mg(C_5HO_2F_6)_2$), $SnCl_4$, β-diketonate compounds of Ba (e.g., $Ba(C_{11}H_{19}O_2)_2$), $CH_4$, Cs, $B_2H_6$, $Ga(C_2H_5)_3$, $Ga(CH_3)_3$, $PH_3$, $AsH_3$, $In(CH_3)_3$, $O_2$, $N_2O$, NO, $N_2$, and $NH_3$. The current carrying portion of the dynodes according to the present invention may be formed of As-, B-, or P-doped Si, Ge (undoped), Si (undoped), $SiO_x$ (SIPOS), $Si_xN_y$, $Al_xGa_{1-x}As$, and $SnO_x$. Precursors for such materials may be $SiH_4$, $PH_3$, $GeH_4$, $B_2H_6$, $AsH_3$, $SnCl_4$, $Ga(CH_2H_5)_3$, $Ga(CH_3)_3$, $Al(CH_3)_3$, $N_2O$, $N_2$, and $NH_3$.

Selected representative examples of semiconductive and dielectric materials and their precursors which are of particular interest for fabrication of thin-film dynodes by CVD methods are given in Tables I and II, respectively. Table I lists representative materials with ranges of electrical resistivity r at 25° C. that, assuming a film thickness of t=100 nm, yield suitable ranges of sheet resistance $R_s$ for the semiconductive layer 64 of a continuous dynode in either a CEM or MCP.

TABLE I

Materials for Semiconductive Layer (t = 100 nm)

| Material | Precursor | r (Ω:cm) | $R_s$ (Ω/sq) | Device |
|---|---|---|---|---|
| Si (P-doped) | $SiH_4$ and $PH_3$ | $10^1$–$10^3$ | $10^6$–$10^8$ | CEM |
| Ge (undoped) | $GeH_4$ | $10^1$–$10^2$ | $10^6$–$10^7$ | CEM |
| Si (undoped) | $SiH_4$ | $10^6$–$10^7$ | $10^{11}$–$10^{12}$ | MCP |
| $SiO_x$ (SIPOS) | $SiH_4$ and $N_2O$ | $10^7$–$10^9$ | $10^{12}$–$10^{14}$ | MCP |
| $Si_xN_y$ | $SiH_4$and $NH_3$ | $10^6$–$10^9$ | $10^{11}$–$10^{14}$ | MCP |

Table II identifies representative materials for use as the emissive layer 62 with sufficiently low values of $E_p^I$ to produce adequate or high values of secondary electron yield δ in the electron energy range of 20 eV≦$E_p$≦100 eV.

TABLE II

Materials for Emissive Layer (20eV ≦ $E_p$ ≦ 100eV)

| Material | Precursor | $E_p^I$ (eV) | $\delta = E_p/E_p^I$ |
|---|---|---|---|
| $SiO_2$ glass | $SiH_4$ or $Si(OC_2H_5)_4$ and 02 | ~40 | ~0.5–2.5 |
| $Al_2O_3$ | $Al(CH_3)_3$ or Al $(C_5HO_2F_6)_3$ and $O_2$ | ~25 | ~0.8–4 |
| MgO | $Mg(C_5HO_2F_6)_2$ | ~25 | ~0.8–4 |
| GaP:Cs-O | $Ga(CH_3)_3$, $PH_3$, Cs, and $O_2$ | ~20 | ~1–5 |

While thermally-activated CVD may be practiced in a reactor (not shown) at atmospheric pressure (APCVD), important advantages are gained by reducing the reactor pressure (P) to the range of about 13 Pa (0.1 torr)≦P≦1.3×$10^3$ Pa (10 torr). When P is decreased from about $1.0\times10^5$ Pa (760 torr) to $1.3\times10^2$ Pa (1 torr), the mean free path of gas molecules at T=600° C. increases a thousandfold from about 0.2 μm to 200 μm. In low pressure, thermally-activated CVD (LPCVD), the resulting higher diffusivities of the reactant and product gasses cause the film growth rate to be controlled by kinetic processes at the gas-substrate interface (e.g., adsorption of reactants, surface migration of adatoms, chemical reaction, or desorption of reaction products) rather than by mass transport of the gasses through a stagnant boundary layer adjacent to the interface. By maintaining the surface of a substrate at constant temperature T=300°–1200° C., conformal films can be heterogeneously deposited by LPCVD even over substantial contours because supply of an equal reactant flux to all locations on the substrate is not critical under surface reaction rate-limited conditions. Conformal coverage of films over complex topographies (e.g., along a trench or channel) depends on rapid migration of adatoms prior to reaction. In the case of APCVD, however, lower gas diffusivities promote mass transport-limited conditions where an equal reactant flux to all areas of the substrates is essential for film uniformity.

For this reason, LPCVD is thought to have a greater potential than APCVD for attaining the objective of depositing conformal conductive and emissive layers 64,62 with uniform thicknesses and properties within capillary substrate geometries to form thin-film dynodes for CEMs and MCPs. Also, since LPCVD can provide conformal films without the substrate 66 being in the line-of-sight of the vapor source, it is clearly superior to physical vapor deposition methods (e.g., evaporation and sputtering) for this application. Other noteworthy advantages of LPCVD include better compositional and structural control, lower deposition temperatures, fewer particulates due to homogeneous reactions, and lower processing costs.

As an alternative to thermally-activated LPCVD, plasma-assisted CVD at low pressure (PACVD) is attractive because it offers an even lower range of processing temperatures (T=25°–500° C.) than LPCVD and the considerable potential for synthesizing unusual thin-film materials under non-equilibrium conditions. Photochemically-activated CVD (PCCVD) is another low temperature processing variant of interest.

If a graduation in film thickness along the length of a channel is desired, the pressure may be raised to reduce gas transport and promote nonuniform deposition along the channel axis without departing from the invention. Likewise, staged deposition may be achieved by producing one or more continuous, interconnected thin-film dynode elements, each being uniform over a substantial length. Also, the deposition parameters may be held constant or varied gradually so that, respectively, a single compositionally uniform film is deposited which desirably exhibits both conductive and emissive properties, or the composition and properties of the film or films vary with thickness to achieve some desirable purpose.

Aside from electrical requirements, substrates for CEMs and MCPs should be comprised of materials that are readily formable into the geometries of such devices but also compatible with CVD processing methods. Contemplated deposition temperatures of 300°–1200° C. for LPCVD require a substrate to be sufficiently refractory so that it does not melt or distort during processing. In addition, the substrate should be chemically and mechanically suited to the overlying thin films such that deleterious interfacial reactions and stresses are avoided. Moreover, the substrate should be made of a material with adequate chemical purity such that control over the deposition process and essential properties of the thin-film dynodes are not compromised by contamination effects. Finally, for electron multipliers that operate at a high bias current, substrates with high thermal conductivity (k) would assist the dissipation of Joule heat.

In accordance with the present invention, the substrate may be a material selected from the group consisting of $Si_3N_4$, AlN, $Al_2O_3$, $SiO_2$ glass, $R_2O$—$Al_2O_3$—$_{SiO2}$ (R=Li, Na, K) glasses, $R_2O$—BaO—$Bi_2O_3$—PbO—$SiO_2$ (R=Na, K, Rb, Cs) glasses, AlAs, GaAs, InP, GaP, Si, Si with a $SiO_2$ isolation layer, and GaAs or InP with a $Si_3N_4$ isolation layer.

Selected representative examples of refractory, high purity materials suitable for substrates 66,76,82 are given in Table III with nominal values of bulk electrical resistivity r and thermal conductivity k at 25° C.

TABLE III

| Substrate Materials | | | |
|---|---|---|---|
| Material | r (Ω· cm) | k(W/m – °K.) | Device (Substrate) |
| AlN | $>10^{14}$ | >150 | CEM (66) and MCP (66) |
| $Al_2O_3$ | $>10^{14}$ | 20 | CEM (66) and MCP (66) |
| $SiO_2$ glass | $>10^{14}$ | 1 | CEM (66) and MCP (66) |
| Si (undoped) with $SiO_2$ isolation layer | $>10^{12}$ | — | MCP (82) |
| GaP (undoped) | $>10^{10}$ | — | MCP (76) |
| GaAS (undoped) | $\sim10^8$ | 46 | MCP (76) |
| Si (undoped) | $\sim10^5$ | 150 | CEM (76) |

A dielectric substrate for a CEM can be produced, for instance, by thermal working of fused quartz glass or by injection molding and sintering of ceramic powders of $Al_2O_3$ or AlN. The use of lithographic methods and etching with a flux of reactive particles to create an array of anisotropically etched hollow channels in wafer-like substrates of materials such as $SiO_2$, Si, or GaAs for MCPs is also possible as described in Horton et al. noted above.

According to the invention, vapor deposition methods based on CVD can be used to fabricate continuous thin-film dynodes with electrical and electron emissive properties that are comparable to those obtained with conventional RLSG dynodes. Because of this, more efficient manufacturing procedures for CEMs and MCPs are available, including improvements in RLSG configurations. Further, it is expected that significant improvements in the performance of CEMs and MCPs made in accordance with the teachings of the present invention can be achieved by capitalizing on the ability to tailor the materials and structure of thin-film dynodes.

The advantages which may be achievable include better multiplication statistics and operation at a lower external bias potential $V_B$ by deposition of an emissive layer 62 with higher secondary electron yield δ than conventional RLSG dynodes (e.g., MgO or negative electron affinity emitters such as GaP:Cs—O). Better gain stability and longer operational lifetimes (e.g., ≧100 C/$cm^2$ of extracted charge) are achievable by use of an emissive layer 62 such as $Si_3N_4$ or $Al_2O_3$ which exhibits low susceptibility to outgassing or degradation by electron irradiation. Improved noise characteristics and extended dynamic range result from choice of high-purity materials for dynodes and substrates which are free of radioactive impurities, a major source of background noise. Maximum operating temperatures approaching 500° C. are achieved by use of suitably refractory materials for dynodes and substrates. Environmental stability is enhanced by application of an emissive layer 62 (e.g., $Si_3N_4$) that can also function as a hermetic seal for environmentally sensitive dynode materials such as RLSG. Very importantly, the current transfer characteristics for specific applications may be optimized by exercising control over the physical dimensions, composition and morphology, and hence the electrical and electron emissive properties of the films 62,64.

Thin-film processing according to the present invention includes treatment of the surfaces of semiconductive films or surfaces of bulk semiconductor substrate materials to achieve desirable electron emissivity. In embodiments referred to in FIGS. 4 and 6 the surface 68 of a semiconductive layer 64 such as silicon may be oxidized (or nitrided) at 300°–1200° C. in $O_2$ (or $NH_3$) to produce an emissive layer 62 of thermal $SiO_2$ (or $Si_3N_4$) with thickness d=2–20 nm. In FIG. 5 a bulk semiconductor 76 such as silicon may be treated in a similar manner to produce an emissive surface. Also, dielectric films such as $SiO_2$ may be formed by liquid phase deposition (LPD) to form the emissive layer 62 or the isolation layer 84 in the embodiments of FIGS. 4–7. Using LPD, for instance, $SiO_2$ films can be deposited at 25°–50° C. onto the interior surfaces of macroscopic or microscopic capillary channels of CEMs or MCPs from a supersaturated aqueous solution of $H_2SiF_6$ and $SiO_2$ with a small addition of $H_3BO_3$. The above processes may be combined with other processes herein described to produce various continuous thin-film dynode configurations.

Examples which describe fabrication and performance of CEM and MEM devices prepared in accordance with the present invention are set forth below.

EXAMPLE I

Fused quartz capillary tubes (1 mm ID×3 mm OD) with one end flared into an input cone, similar to the tube 102 illustrated in FIG. 8, were employed as substrates to make sets of straight-channel CEMs with $\alpha$=L/D=20, 30, and 40, and curved-channel CEMs with $\beta$=L/S=1.2.

The substrates were first cleaned by a standard procedure and then placed inside a hot-wall, horizontal-tube, LPCVD reactor for deposition of silicon thin films. Amorphous undoped silicon films were formed on one set of substrates by reaction of $SiH_4$ at P=26–52 Pa (0.2–0.4 torr) and T=540°–560° C. In a separate experiment, amorphous P-doped silicon films were formed on another set of substrates by reaction of $PH_3$ and $SiH_4$ in a reactant ratio of $PH_3/SiH_4=5\times10^{-4}$ under otherwise similar conditions. Semiconductive films 64 of thickness t≃300 nm were thus deposited on surfaces 112,114 of capillary substrates 102 (FIG. 8) at a rate of 1–10 nm/min.

After deposition of the silicon films, the capillary substrates were allowed to cool in the reactor and then were assembled into CEMs 100 as follows. Electrical continuity along the outer surface 114 of the capillary tubes was broken by removing the silicon deposit within a narrow band 118 around this outer surface (FIG. 8). Nichrome electrodes 108 were then vacuum-evaporated onto the ends of each tube without coating the non-conductive band between them. Each CEM was completed by attaching electrical leads to both electrodes.

Measurements of electrical resistance down the bore of the straight-channel CEMs showed that the undoped and P-doped silicon films had sheet resistances $R_s\simeq10^{11}\Omega$/sq and≃$10^8\Omega$/sq, respectively. In both cases, $R_s$ was independent of channel geometry for $20\leqq\alpha\leqq40$. These results indicate that both the thickness and resistivity of each film, as prepared by LPCVD methods, are substantially uniform along the length of capillary channels with aspect ratios sufficient to support useful electron multiplication.

Figure 11:
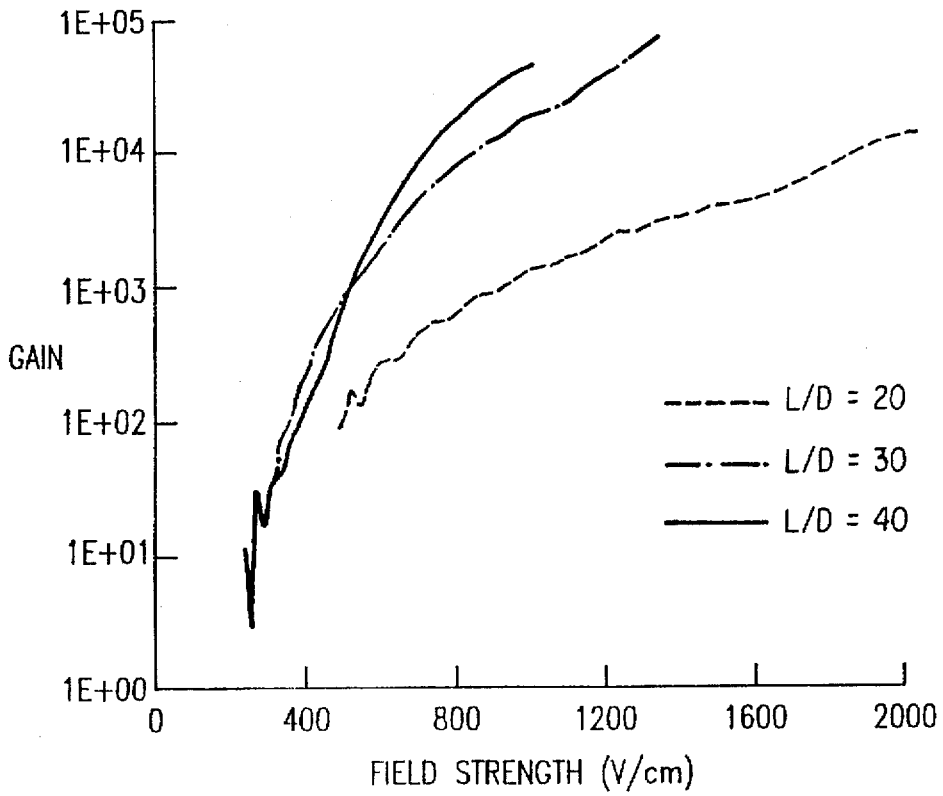
FIG. 11 is a plot of signal gain verses electric field strength for exemplary straight-channel electron multipliers with different aspect ratios employing a thin-film dynode according to the present invention.

Methods for characterizing the gain G of electron multipliers in analog and pulse counting modes are known. Plots of analog gain $G=I_o/I_i$ versus electric field strength E applied to straight-channel CEMs 100 having $\alpha$=20, 30, and 40 with $R_s\simeq10^8\Omega$/sq for input currents $I_i$=1 pA are presented in FIG. 11. While unsaturated gains $G\geqq10^4$ were obtained for each CEM, one also sees the G increases with $\alpha$ at sufficiently large vales of $\epsilon$.

Figure 12:
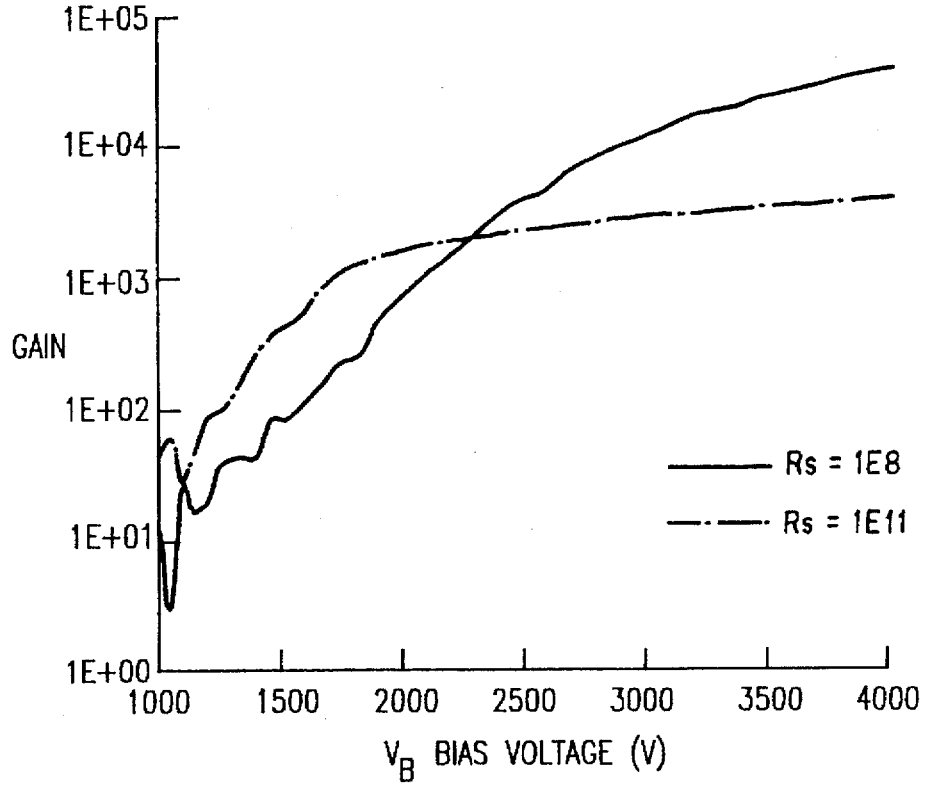
FIG. 12 is a plot of signal gain verses bias voltage for exemplary straight-channel electron multipliers of different electrical resistance employing a thin-film dynode according to the present invention.

Graphs of analog gain $G=I_o/I_i$ versus bias voltage $V_B$ for straight-channel CEMs 100 having $R_s\simeq10^{11}\Omega$/sq and≃$10^8\Omega$/sq with $\alpha$=40 for $I_i$=1 pA are given in FIG. 12. The CEM with higher $R_s$ shows a saturated gain $G=10^3$–$10^4$ and is limited by the relatively low bias current $i_B$ that is carried in the semiconductive layer. In contrast, the CEM with lower $R_s$ exhibits an unsaturated gain $G>10^4$.

Figure 13:
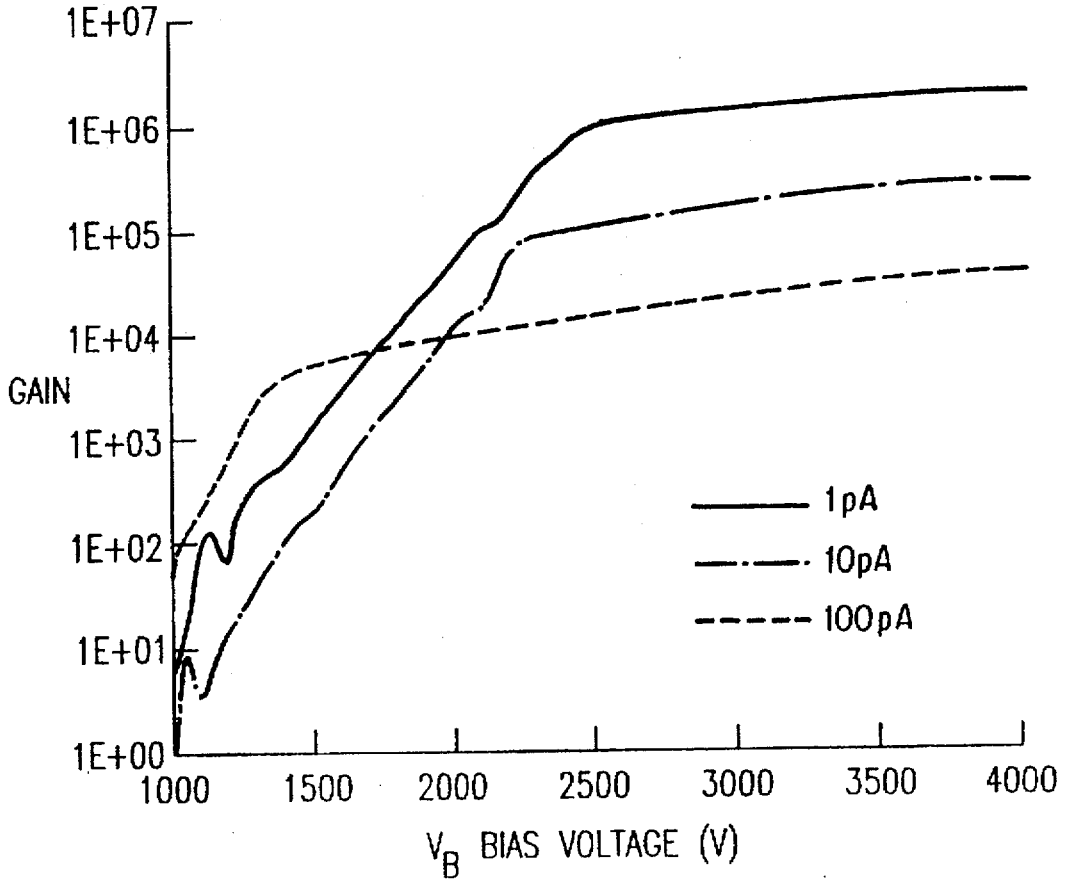
FIG. 13 is a plot of signal gain verses bias voltage at different input current levels for an exemplary curved-channel electron multiplier employing a thin-film dynode according to the present invention.

FIG. 13 displays plots of analog gain $G=I_o/I_i$ versus voltage for a curved-channel CEM 100 with $\beta$=1.2 and $R_s\simeq10^8\Omega$/sq for several values of $I_i$=1, 10, and 100 pA. Saturated gains are observed at all input levels $I_i$. In particular, the roughly order of magnitude decreases in saturated gain with corresponding increases in $I_i$ clearly indicate a current-limited multiplier response. For $I_i$=1 pA, this CEM shows a maximum gain $G>10^6$.

EXAMPLE II

Fused quartz plates (25×60×1 mm) similar to the plates 142 that are illustrated in FIG. 10, were used as substrates to form thin-film dynodes for a MEM 140. Amorphous P-doped silicon films with t≃300 nm and $R_s\simeq10^8\Omega$/sq were formed on the planar substrates 142 using methods and conditions similar to those described in Example I for the CEMs.

The MEM was assembled as follows. The silicon deposit was removed from one flat surface 151. A pattern of nichrome electrodes was then deposited through a mask (not shown) onto the other side of each plate 142 with the silicon deposit 148. A set of two plates 142 with closely matched $R_s$ were used as field and dynode strips to construct the MEM 140.

Figure 14:
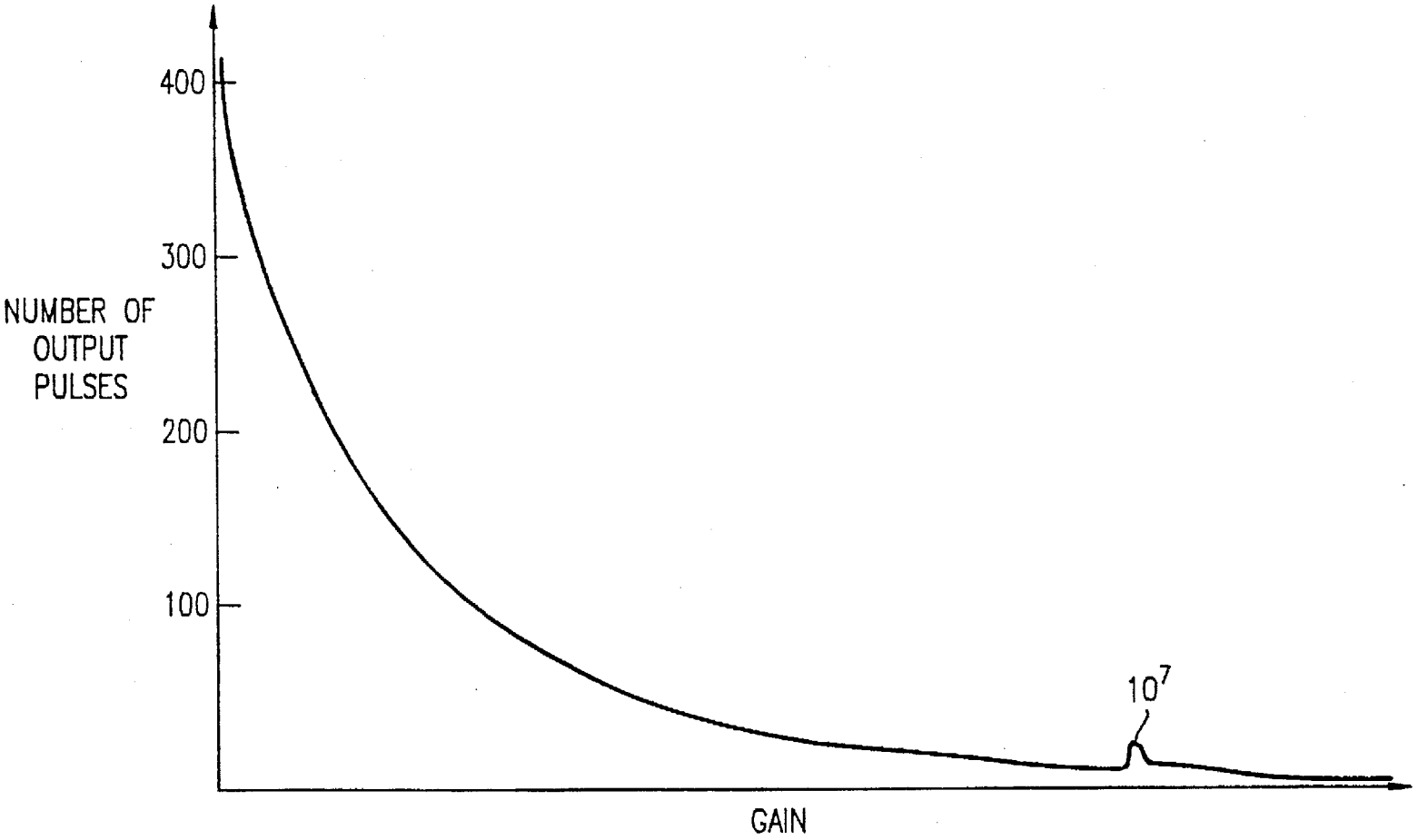
FIG. 14 is a plot of the pulse height distribution of a magnetic electron multiplier employing a thin-film dynode of the present invention.

Pulse counting measurements on the MEM 140 yielded the pulse height distribution given in FIG. 14. The distribution shown represents the number of output pulses as a function of gain, relative to a calibration line of $G=10^7$. When operated at a bias voltage $V_B$=2500 V, the MEM 140 exhibited a negative exponential pulse height distribution with a maximum gain in the range of $10^6$–$10^7$.

The structure of the thin-film dynodes in the above described CEMs 100 and MEM 140 of Examples I and II approximates the embodiment depicted in FIG. 4. A native oxide of $SiO_2$ with thickness d=2–5 nm serves as the emissive layer 62 and overlies a silicon semiconductive layer 64, which are both supported by a fused quartz substrate 66. The feasibility of such thin film dynodes to support practical levels of electron multiplication has clearly been established by the foregoing Examples. Further, the ability to tailor the current transfer characteristics of an electron multiplier by adjusting the current-carrying properties of a thin-film dynode has been demonstrated. Also, the formation and control of semiconductive films 64 with electrical properties which are suitable for single-channel devices (e.g., P-doped silicon with $R_s\simeq10^8\Omega$/sq) as well as for multi-channel ones (e.g., undoped silicon with $R_s \simeq 10^{11}\Omega/sq$) have been shown. Finally, one notes that while the signal gains of thin-film devices in Examples I and II approach those of comparable RLSG devices, the performance of the former could be improved by forming a somewhat thicker emissive layer 62 by thermal oxidation or nitriding reactions or by depositing an emissive layer 62 such as MgO with better secondary electron emission characteristics than native $SiO_2$.

While the invention has been described in connection with specific embodiments thereof, it will be understood that it is capable of further modifications. This application is intended to cover any variations, uses or adaptations of the invention following, in general, the principles of the invention, and including such departures from the present disclosure as come within known and customary practice within the art to which the invention pertains.

What is claimed is:

1. A method of forming a continuous dynode for an electron multiplier comprising the steps of:

forming at least one channel in a substrate said at least one channel having a wall portion; forming at least one thin film on the wall portion of the channel to produce at least one of a current carrying portion and an overlying electron emissive portion, said at least one thin film being formed by at least one of low pressure chemical vapor deposition (LPCVD), liquid phase deposition (LPD), and oxidation and nitriding.

2. The method of claim 1 wherein said forming step includes forming the at least one channel in the substrate with aspect ratio of about at least 30 for deposition of the dynode therein.

3. The method of claim 1 further comprising forming the dynode conformally with a uniform thickness on the channel wall along at least a selected length thereof.

4. The method of claim 1 further comprising forming the dynode with uniform electrical and electron emissive properties along a selected length thereof.

5. The method of claim 1 further comprising forming the dynode with electrical or electron emissive properties which vary with the distance from the substrate.

6. The method of claim 1 wherein LPCVD is carried out at a temperature in a range of about 300° C. and 1200° C.

7. The method of claim 1 wherein LPCVD is carried out at a pressure below about 10 torr.

8. The method of claim 1 wherein LPCVD is carried out at a pressure below about 1 torr.

9. The method of claim 1 wherein LPCVD is carried out at a pressure in a range of about 1 torr and 0.1 torr.

10. The method of claim 1 wherein the substrate comprises a material selected from the group consisting of $Si_3N_4$, AlN, $Al_2O_3$, $SiO_2$ glass, $R_2O$—$Al_2O_3$—$SiO_2$ (R=Li, Na, K) glasses, $R_2O$—BaO—$Bi_2O_3$—PbO—$SiO_2$ (R=Na, K, Rb, Cs) glasses, AlAs, GaAs, InP, GaP, and Si.

11. The method of claim 1 wherein the electron multiplier is a MCP and the substrate materials have a resistivity of about $r \geqq 10^8$ Ω.cm.

12. The method of claim 1 wherein the electron multiplier is a CEM and the substrate has a resistivity of about $10^5$ Ω.cm$\leqq r \leqq 10^8$ Ω.cm.

13. The method of claim 1 wherein the electron multiplier is a CEM and the substrate has a resistivity of about $r \geqq 10^{12}$ Ω.cm.

14. The method of claim 1 wherein the emissive portion comprises a thin film of one or more materials selected from the group consisting of $SiO_2$, $Al_2O_3$, MgO, $SnO_2$, BaO, $Cs_2O$, $Si_3N_4$, $Si_xO_yN_z$, C (Diamond), BN and AlN; negative electron affinity emitters GaP:Cs—O, GaP:Ba—O, GaAs:Cs—O, InP:Cs—O, and Si:Cs—O.

15. The method of claim 1 wherein the emissive portion comprises a thin film with a thickness of 2–20 nm.

16. The method of claim 1 wherein precursors for the emissive portion include materials selected from the group consisting of $SiH_4$, $SiCl_xH_y$, $Si(OC_2H_5)_4$, β-diketonate compounds of Al (e.g., $Al(C_5HO_2F_6)_3$), $Al(CH_3)_3$, β-diketonate compounds of Mg (e.g., $Mg(C_5HO_2F_6)_2$), $SnCl_4$, β-diketonate compounds of Ba (e.g., $Ba(C_{11}H_{19}O_2)_2$), $CH_4$, Cs, $B_2H_6$, $Ga(C_2H_5)_3$, $Ga(CH_3)_3$, $PH_3$, $AsH_3$, $In(CH_3)_3$, $O_2$, NO, $N_2O$, $N_2$, and $NH_3$.

17. The method of claim 1 wherein the current carrying portion comprises a thin film material selected from the group consisting of As-, B-, or P-doped Si, Ge (undoped), Si (undoped), $SiO_x$ (SIPOS), $Si_xN_y$, $Al_xGa_{1-x}As$, and $SnO_x$.

18. The method of claim 1 wherein the current carrying portion comprises a thin film with a thickness of about 10–1000 nm.

19. The method of claim 1 wherein precursors for the materials forming the current carrying portion comprise materials selected from the group consisting of $SiH_4$, $PH_3$, $GeH_4$, $B_2H_6$, $ASH_3$, $SnCl_4$, $Ga(C_2H_5)_3$, $Ga(CH_3)_3$, $Al(CH_3)_3$, $N_2O$, $N_2$ and $NH_3$.

20. The method of claim 1 wherein the current carrying portion comprises a thin film with a sheet resistance of about $10^6$ Ω/sq$\leqq R_s \leqq 10^8$ Ω/sq for channel electron multipliers.

21. The method of claim 1 wherein the current carrying portion comprises a thin film with a sheet resistance of about $10^{11}$ Ω/sq$\leqq R_s \leqq 10^{14}$ Ω/sq for microchannel plates.

22. The method of claim 1 wherein the substrate is a dielectric and first a thin film of a current carrying material and then a thin film of an electron emissive material are deposited by LPCVD onto the dielectric substrate.

23. The method of claim 1 wherein the substrate is conductive and first a dielectric isolation layer is formed on the wall portion of the conductive substrate, followed by deposition by LPCVD of a current carrying thin film and then formation an electron emissive thin film by one of LPCVD, LPD, and oxidation and nitriding.

24. The method of claim 23 wherein the isolation layer is formed onto the wall portion of the conductive substrate by at least one of LPCVD, and oxidation and nitriding.

25. The method of claim 1 wherein a thin film of an electron emissive material is formed by LPCVD onto a current carrying bulk semiconductor substrate.

26. The method of claim 1 wherein a thin film of an electron emissive material is deposited onto a current carrying layer of reduced lead silicate glass overlying a mechanical support of unreduced lead silicate glass.

27. The method of claim 1 wherein first a thin film of current carrying material is formed by LPCVD onto a dielectric substrate and then the free surface of said current carrying film is altered to exhibit emissive properties by exposing said free surface to a reactive gas.

28. The method of claim 27 wherein the reactive gas is a material selected from the group consisting of $NH_3$ and $O_2$.

29. The method of claim 27 wherein the alteration of the surface occurs at an elevated temperature.

30. The method of claim 1 wherein first a thin film of current carrying material is deposited by LPCVD onto a dielectric substrate and then a layer of electron emissive material is deposited by LPD from a supersaturated solution of such layer-forming material.

31. The method of claim 30 wherein the emissive material is $SiO_2$ and the supersaturated solution contains $H_2SiF_6$ and $SiO_2$ in $H_2O$.

32. The method of claim 1 wherein LPCVD comprises at least one of thermal-activated LPCVD; plasma-assisted LPCVD; and photochemically-activated LPCVD.

33. The method of claim 1 wherein the thin-film forming step further includes the step of forming a hermetic seal on the channel wall such that outgassing from the channel wall is reduced to a level below that experienced by RLSG dynodes.

34. The method of claim 1 wherein the thin-film forming step includes the step of forming an emissive film resistant to degradation under electron irradiation to a level greater than that experienced by RLSG dynodes.

35. The method of claim 1 wherein said thin-film forming step further includes selecting a temperature of formation, such that the substrate has a generally uniform temperature during said forming step.

36. The method of claim 47 wherein LPD occurs at about 25°–50° C.

37. The method of claim 1 wherein the substrate comprises at least one of: Si with a $SiO_2$ isolation layer; and GaAs or InP with a $Si_3N_4$ isolation layer.

38. The method of claim 1 wherein the step of forming said at least one thin film by LPCVD comprises the steps of: reacting a vapor in the presence of the substrate at a temperature and at a pressure selected to result in CVD kinetics which are dominated by interfacial processes between the vapor and the substrate, said current carrying portion having a resistance capable of carrying an adequate current to replace emitted electrons and establishing an accelerating field for said emitted electrons, and the emissive portion having a secondary electron yield capable of resulting in electron multiplication.

39. The method according to claim 1 said at least one thin film being substantially free of lead silicate glass such that said dynode exhibits a resistance to damage caused by electron bombardment greater than lead silicate glass and exhibits a susceptibility to outgassing in vacuum less than RLSG.

40. The method according to claim 1 wherein said continuous thin-film dynode replicates the function of reduced lead silicate glass (RLSG) dynodes in an electron multiplier wherein the step of forming said electron emissive portion is performed essentially free of a material which is silica-rich, alkali-rich and lead-poor so as to exhibit at least one of the following characteristics: a) resistance to radiolytic damage caused by electron bombardment greater than RLSG, for extending the operational lifetime of said dynode, b) a susceptibility to outgassing in vacuum less than RLSG, for providing a corresponding improvement in gain stability to said dynode, and c) a hermetic seal more protective than RLSG, for proving a corresponding increase in environmental stability to said dynode.

41. The method according to claim 40 wherein said at least one thin film is formed substantially free of radioactive materials and has a corresponding dynamic range greater than RLSG dynodes.

42. The method of claim 1 wherein said forming step includes forming the at least one channel in the substrate having an aspect ratio in a range of about 30 to about 80 for deposition of the dynode therein.

43. A method of forming a continuous dynode for an electron multiplier comprising:

forming at least one channel in a bulk semiconductor substrate said at least one channel with a wall portion having a free surface and a current carrying portion near said free surface capable of carrying a current adequate to replace emitted electrons and to establish an accelerating field for said emitted electrons and forming a thin-layer on the free surface having an emissive property by altering the free surface by exposing it to an oxidizing or nitriding reactive gas, said emissive property having a secondary electron yield capable of resulting in electron multiplication.

44. The method of claim 43 wherein said reactive gas is selected from the group consisting of $O_2$ and $NH_3$.

45. The method of claim 43 wherein said reaction occurs at an elevated temperature above room temperature.

46. A method of forming a continuous dynode for an electron multiplier comprising the steps of:

forming at least one channel in a substrate, said one channel having a free surface and a current carrying portion near said free surface capable of carrying a current adequate to replace emitted electrons and to establish an accelerating field for said emitted electrons and forming at least one thin film at the free surface having an emissive property by liquid phase deposition (LPD), said emissive portion having a secondary electron yield capable of resulting in electron multiplication.

47. The method of claim 46 wherein the emissive film is a film of $SiO_2$ formed from a supersaturated aqueous solution of $H_2SiF_6$ and $SiO_2$ with a small addition of $H_3BO_3$.

48. The method of claim 46 wherein a thin film of an electron emissive material is deposited onto a current carrying layer of reduced lead silicate glass overlying a mechanical support of unreduced lead silicate glass.

49. The method of claim 46 wherein the substrate is a bulk semiconductor.

* * * * *

UNITED STATES PATENT AND TRADEMARK OFFICE

CERTIFICATE OF CORRECTION

PATENT NO. : 5,726,076

DATED : March 10, 1998

INVENTOR(S) : G. William TASKER
Jerry Randall HORTON

It is certified that error appears in the above-identified patent and that said Letters Patent is hereby corrected as shown below:

ON THE TITLE PAGE

Item [62] should read --

Division of Ser. No. 89,771, July 12, 1993, Pat. No. 5,378,960, which is a continuation of Ser. No. 395,588, Aug. 18, 1989, abandoned.

Signed and Sealed this

Twelfth Day of May, 1998

Bruce Lehman

*Attest:*

BRUCE LEHMAN

*Attesting Officer*

*Commissioner of Patents and Trademarks*